US008096538B2

(12) United States Patent
Herbold et al.

(10) Patent No.: US 8,096,538 B2
(45) Date of Patent: Jan. 17, 2012

(54) APPARATUS FOR CLEANING AND ORGANIZING FASTENERS USED IN DYNAMOELECTRIC MACHINE

(75) Inventors: John W. Herbold, Fountain Inn, SC (US); Ryan M. Pastrana, Acworth, GA (US); Kahwai G. Muriithi, Simpsonville, SC (US); Jennifer L. Gant, Atlanta, GA (US); Coy Y. Jackson, Houston, TX (US); Jeffrey J. Nelson, Edmond, OK (US)

(73) Assignee: General Electric Company, Schenectady, NY (US)

( * ) Notice: Subject to any disclaimer, the term of this patent is extended or adjusted under 35 U.S.C. 154(b) by 35 days.

(21) Appl. No.: 12/720,016

(22) Filed: Mar. 9, 2010

(65) Prior Publication Data

US 2011/0220601 A1 Sep. 15, 2011

(51) Int. Cl.
*B25B 1/20* (2006.01)

(52) U.S. Cl. ..... 269/37; 269/900; 269/296

(58) Field of Classification Search ..... 269/37, 269/900, 291, 43, 296; 29/281.1
See application file for complete search history.

(56) References Cited

U.S. PATENT DOCUMENTS

| | | | | |
|---|---|---|---|---|
| 3,780,852 | A | 12/1973 | Weiss et al. | |
| 3,785,634 | A * | 1/1974 | Denker | 269/71 |
| 4,869,304 | A * | 9/1989 | Gore | 144/354 |
| 4,913,501 | A | 4/1990 | Swank | |
| 5,069,464 | A | 12/1991 | Braconnier | |
| 5,494,268 | A * | 2/1996 | Heintz | 269/69 |
| 5,544,744 | A | 8/1996 | Oman | |
| D387,978 | S * | 12/1997 | McNally, Jr. | D8/356 |
| 5,727,778 | A * | 3/1998 | Nodar | 269/43 |
| D414,936 | S | 10/1999 | Doubek | |
| 6,050,660 | A | 4/2000 | Gurley | |
| 6,338,477 | B1 * | 1/2002 | Moore | 269/60 |
| 2008/0296335 | A1 | 12/2008 | McEwin | |

* cited by examiner

*Primary Examiner* — Lee D Wilson
(74) *Attorney, Agent, or Firm* — James W. Pemrick; Ernest G. Cusick; Frank A. Landgraff

(57) ABSTRACT

An apparatus is provided for organizing and cleaning fasteners used in a dynamoelectric machine. The apparatus includes a frame having a first end wall and a second end wall opposed to the first end wall, and a plurality of shelves connected to and located between the first end wall and the second end wall. At least one of the shelves includes a plurality of concave regions, that are configured to retain at least one of the fasteners. A mounting region is provided for the attachment of a fastener clamp. The fasteners from the dynamoelectric machine can be stored on the plurality of shelves and displayed.

13 Claims, 10 Drawing Sheets

APPARATUS FOR CLEANING AND ORGANIZING FASTENERS USED IN DYNAMOELECTRIC MACHINE

BACKGROUND OF THE INVENTION

The present invention relates to fasteners used in dynamoelectric machines, and particularly relates to an apparatus for cleaning and organizing the fasteners used in the outer case of a dynamoelectric machine.

The upper and lower outer shell casings of dynamoelectric machines (e.g., turbines or compressors) are conventionally bolted to one another along the flanges at a horizontal midline. The bolts or studs used to close the joint between the upper and lower outer shell casings conventionally range in diameter from about one to about six inches with lengths ranging from about one foot to about six feet. In some known turbines, the joint between the upper and lower outer shell casings is direct metal to metal contact. Prior to forming the joint, the metal surfaces are scraped and stoned to provide clean surfaces. The fasteners used to join the upper and lower shell casings may also be cleaned prior to installation (this is especially important after disassembly and/or maintenance procedures).

To service the dynamoelectric machine, the upper and lower outer shell casings are unbolted along the horizontal midline and the upper shell casing is removed. It will be appreciated that a typical un-bolting, re-bolting or temporary bolting of the upper outer shell casing to the lower outer shell casing can be an arduous and lengthy task. For example, the bolts removed from the machine can be difficult for mechanics to lift. Many bolts and nuts are used in a typical machine, and these fasteners are normally piled on the floor during disassembly. Normally, two or more eight hour shifts are necessary for the mechanics to remove the fasteners used to close the two shells. Further, when the initially removed bolts are reused, the bolts must be cleaned before they are re-installed. With that requirement, the machine must be maintained in an out-of-service condition for the additional time period required to clean the used set of bolts. The bolts then must be inventoried and sorted to verify they are returned to the correct location. Accordingly, the known approaches for removing fasteners in dynamoelectric machines result in a lengthy and expensive process.

BRIEF DESCRIPTION OF THE INVENTION

In one aspect of the present invention there is provided an apparatus for fasteners used in a dynamoelectric machine. The apparatus includes a frame having a first end wall and a second end wall opposed to the first end wall, and a plurality of shelves connected to and located between the first end wall and the second end wall. At least one of the shelves includes a plurality of concave regions, that are configured to retain at least one of the fasteners. A mounting region is provided for the attachment of a fastener clamp. The fasteners from the dynamoelectric machine can be stored on the plurality of shelves and displayed.

In another aspect of the present invention there is provided an apparatus for fasteners used in a dynamoelectric machine. The apparatus includes a fastener clamp having a clamp base for securing the fastener clamp to a mounting region. A fastener mounting block has a plurality of notches. At least one clamp block is provided for clamping the fasteners between the clamp block and at least one of the notches in the fastener mounting block. The fasteners may be cleaned while secured by the fastener clamp.

In another aspect of the present invention there is provided an apparatus for organizing and cleaning fasteners used in a dynamoelectric machine. A clamping unit has a main body with a plurality of fastener retaining sites including a plurality of depressions and/or projections, and the fastener retaining sites are sized to accommodate at least a portion of a head of one of the fasteners. A plurality of clamps, where each one of the clamps are located near each of the fastener retaining sites, are configured to be operable to retain the head of a fastener in the fastener retaining site. The clamping unit is attached to at least one of a frame and top surface of the apparatus.

DETAILED DESCRIPTION OF THE PRESENT INVENTION

Figure 1:
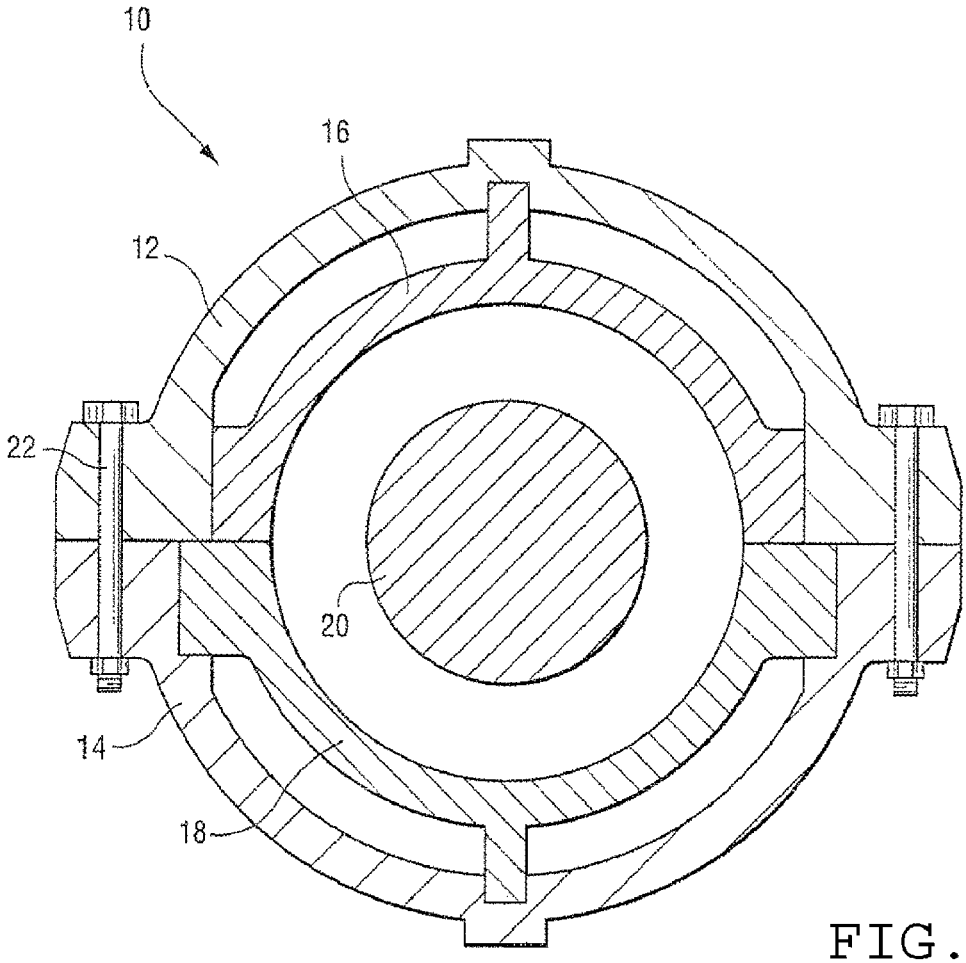
FIG. 1 is a schematic illustration of a cross-section through a turbine illustrating upper and lower shell casings bolted to one another.
Figure 2:
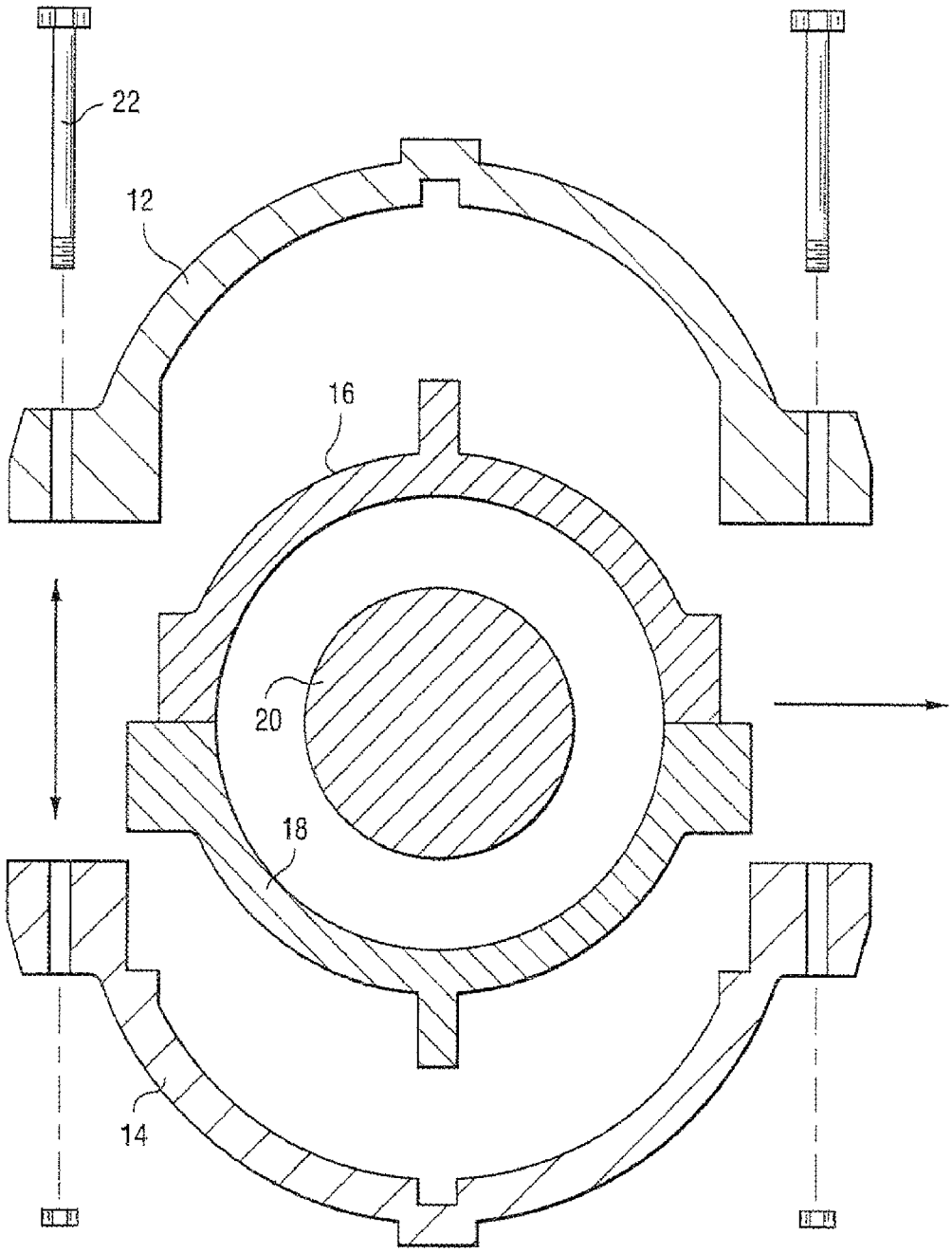
FIG. 2 is a schematic illustration similar to FIG. 1 with parts broken away from one another to illustrate the sequence of removing the upper outer shell and inner casing and rotor from the turbine.

Referring to the drawings, particularly to FIG. 1 and FIG. 2, there is schematically illustrated a cross-sectional view of a dynamoelectric machine (e.g., a turbine, generator, motor or compressor) generally designated 10 comprised of upper and lower outer shell casings 12 and 14 respectively, optional upper and lower inner shell casings 16 and 18 respectively and a rotor 20. It will be appreciated that in order to service the machine the upper outer shell casing 12 must first be unbolted from the lower outer shell casing 14 to expose the inner shell casings (if present) and the rotor 20. To accomplish that, the bolts 22 and nuts 24 which normally secure the upper and lower shell casings 12 and 14 to one another along the horizontal midline of the turbine must first be removed. Once bolts 22 are removed, the upper outer shell 12 is removed together with the inner shell 16 and rotor 20 as schematically illustrated in FIG. 2.

With the rotor 20 and ancillary parts removed from the lower outer shell 14, the turbine may be temporarily closed by bolting the upper and lower outer shells 12 and 14 to one another in order to effect various measurements necessary to the servicing of the turbine. As indicated previously, it is desirable to use clean bolts and fasteners to close the joint between the upper and lower outer shell casings. In addition, there are many fasteners used on different parts of the turbine, and as a non-limiting example on a gas turbine there is a vertical joint between the inlet casing, compressor casing, compressor discharge casing, turbine casing and exhaust casing. This application focuses on one specific group of fasteners, but can be applied to all fasteners used in dynamoelectric machines that have many bolts to organize and clean.

Figure 3:
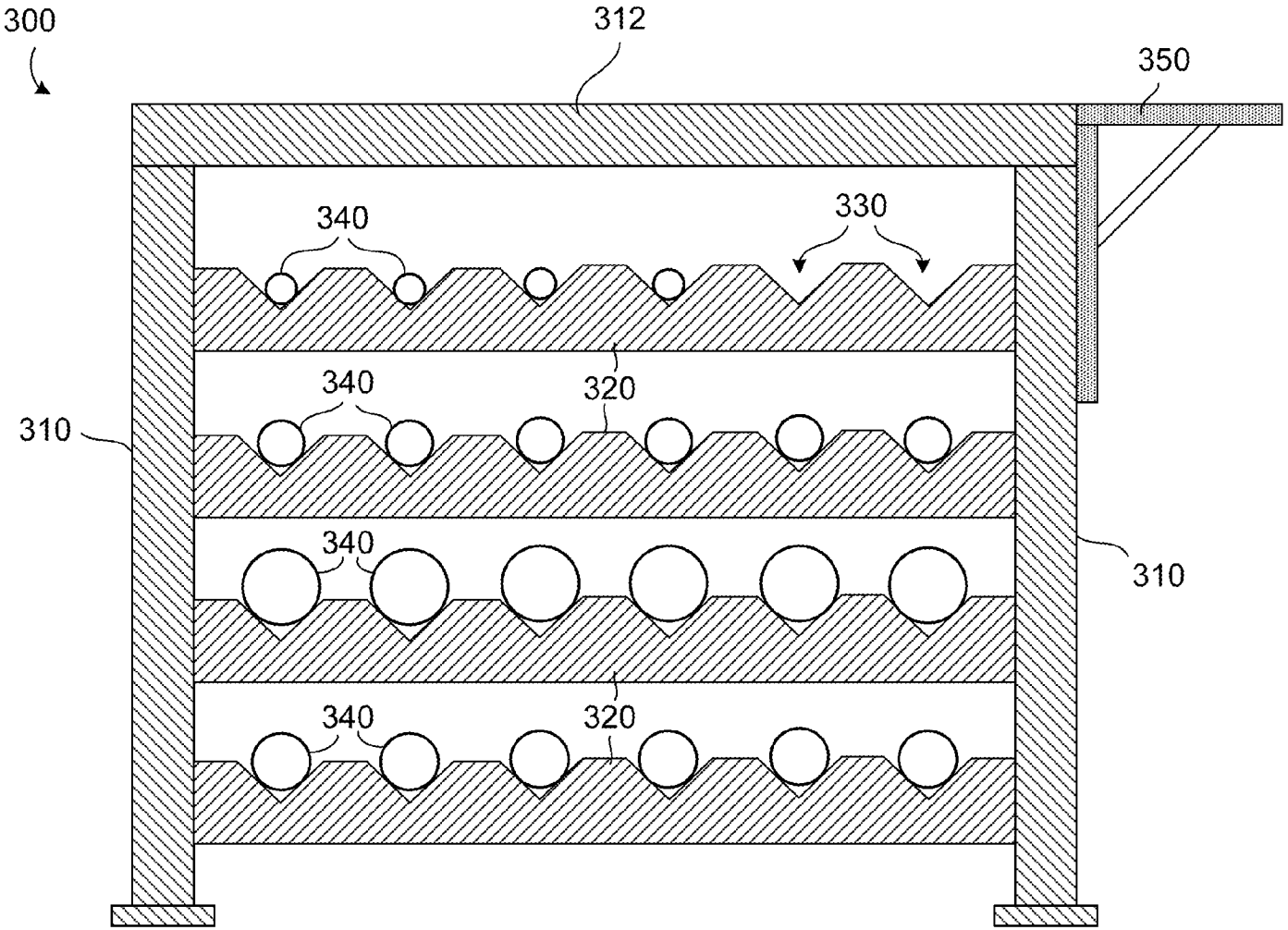
FIG. 3 illustrates a side view of a storage unit that can be used to organize and clean the fasteners used to join the upper and lower shells in a dynamoelectric machine, according to an aspect of the present invention.

FIG. 3 illustrates a side view of a storage unit 300 that can be used to organize and clean the fasteners used to join the upper and lower shells in a dynamoelectric machine. The storage unit 300 includes a frame having side walls 310 and a top surface 312 in contact with both side walls 310. A plurality of shelves or racks 320 are connected to and extend between the side walls 310. Some or all of the shelves 320 may include a plurality of concave regions or notches 330. The notches are configured to accept a variety of fastener sizes, and may be formed generally in a V-shape, as shown in FIG. 3. Alternatively, the notches may be semi-circular or have any suitable shape as desired for the specific application. A bolt is an example of one fastener that can be supported by notches 330. As shown, bolts 340 of different sizes (e.g., length, diameter, etc.) may be supported and retained on shelves 320 in notches 330. A clamp base unit 350 may be attached to one of the side walls 310, or a clamp mounting region can be incorporated into the top surface 312.

One advantage of the present invention, is that as the dynamoelectric machine is being disassembled, the fasteners (e.g., bolts, nuts, washers, etc.) may be placed in the notches 330 in shelves 330 or on top surface 312. This enables a mechanic to quickly make a visual inventory of the parts removed and keeps each fastener organized.

Figure 4:
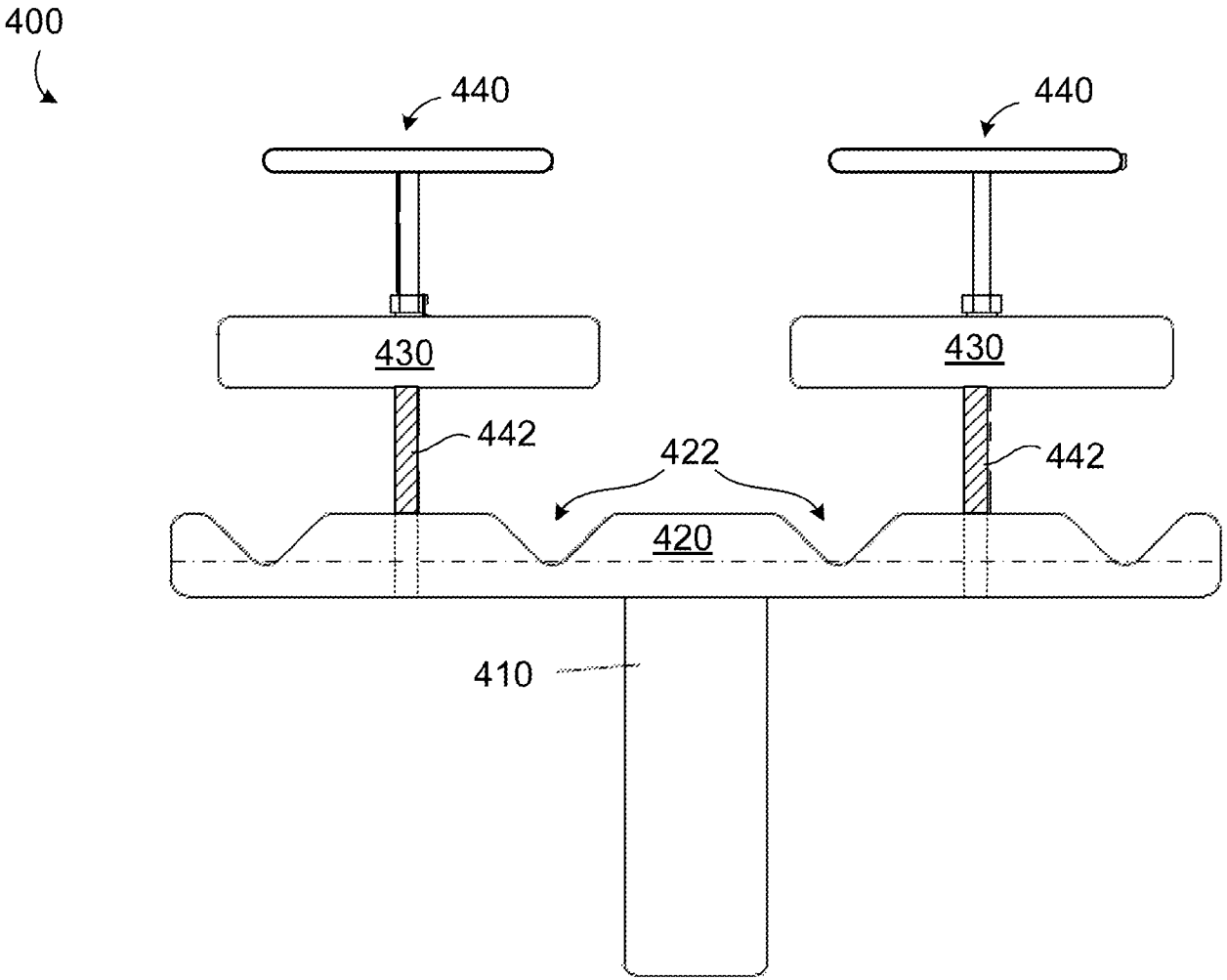
FIG. 4 illustrates a side view of a fastener clamp that can be used to clean fasteners, according to an aspect of the present invention.

FIG. 4 illustrates a side view of a fastener clamp 400, according to an aspect of the present invention. The fastener clamp 400 can be mounted to top surface 312, clamp base unit 350 or anywhere on storage unit 300 desired for the specific application. The fastener clamp 400 could also be connected to a vise (not shown) mounted to storage unit 300. The fastener clamp 400 includes a clamp base 410, fastener mounting block 420, clamp block 430, and handle 440 incorporating threaded rod portion 442. The clamp base 410 can be passed through a suitable orifice in the storage unit 300 or may be clamped in a vise (not shown), which may be attached to storage unit 300. The fastener mounting block 420 includes one or more concave regions or notches 422. Threaded openings 424 are provided through fastener mounting block 420 and accept the threaded rod portion 422 of handle 440.

Figure 5:
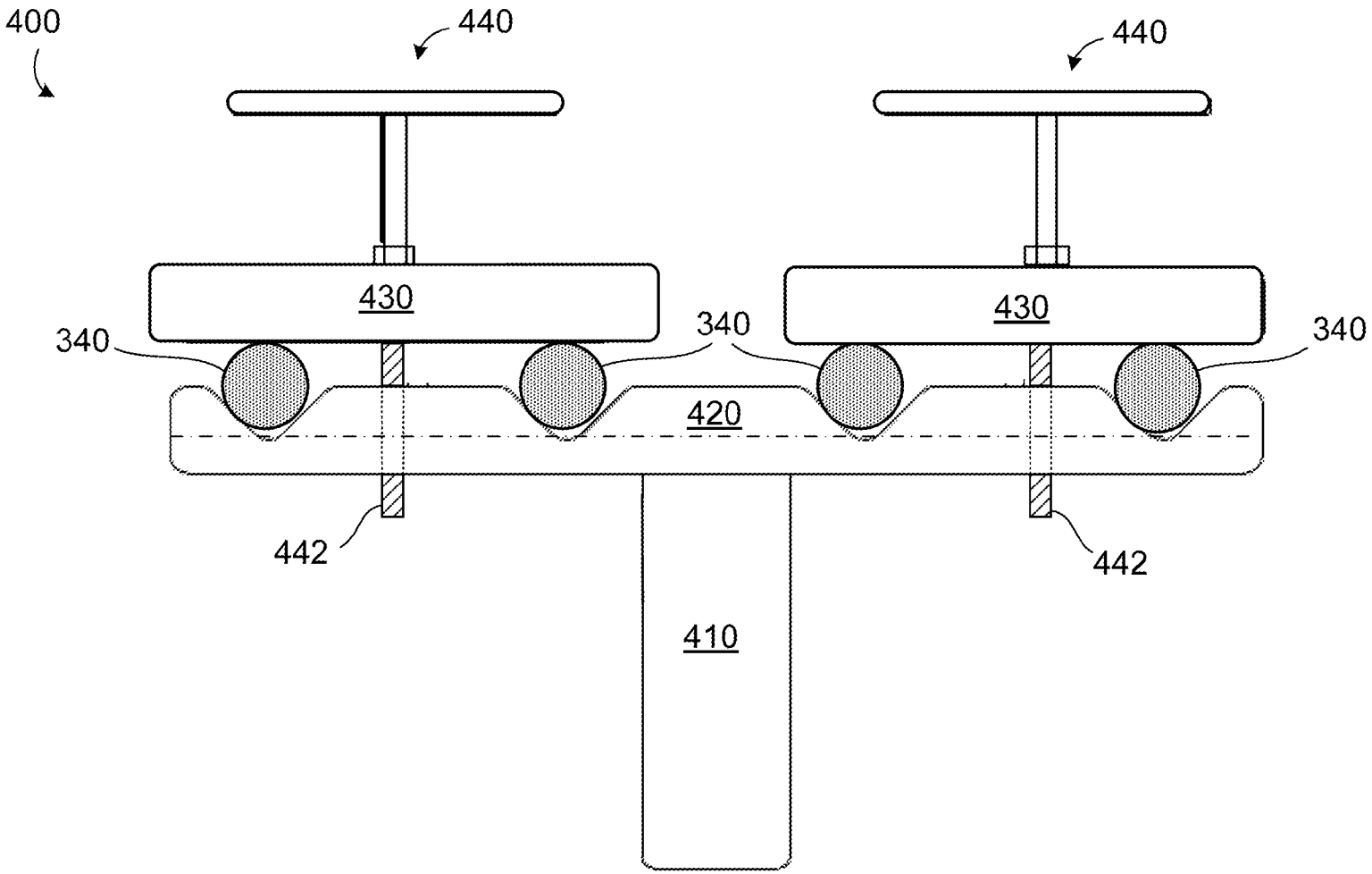
FIG. 5 illustrates a side view of a fastener clamp holding four fasteners in a secure position ready for cleaning, according to an aspect of the present invention.

FIG. 5 illustrates a side view of the fastener clamp 400 having four bolts clamped in position for cleaning. The bolts 340 can be clamped between the fastener mounting block 420 and the clamp blocks 430. As the handle 440 is rotated in one direction (e.g., clockwise), the threaded rod 442 descends through threaded hole 424. Rotation can be continued until the bolts 340 are securely held in place by the fastener mounting block 420 and the clamp blocks 430.

Figure 6:
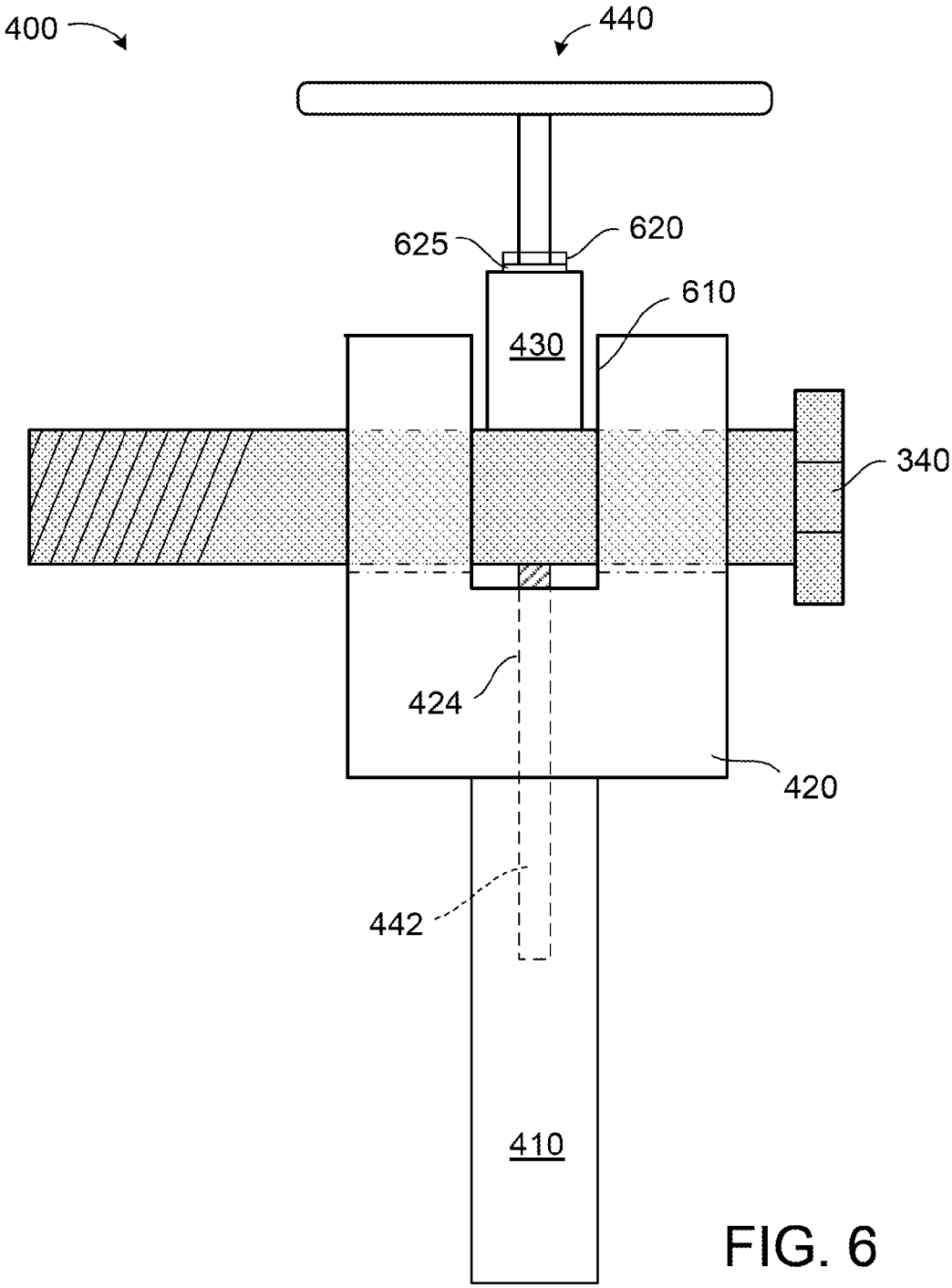
FIG. 6 illustrates an end view of a fastener clamp that can be used to hold and secure fasteners, according to an aspect of the present invention.

FIG. 6 illustrates an end view of the fastener clamp 400. A generally U-shaped channel 610 can be formed to extend through an upper portion of the fastener mounting block 420. The U-shaped channel 610 permits the clamp block 430 to enter the channel 610 and clamp smaller bolts 340. A nut 620 and washer 625 may be used to secure the handle 440 to clamp block 430. However, any suitable fastening arrangement may be employed.

Figure 7:
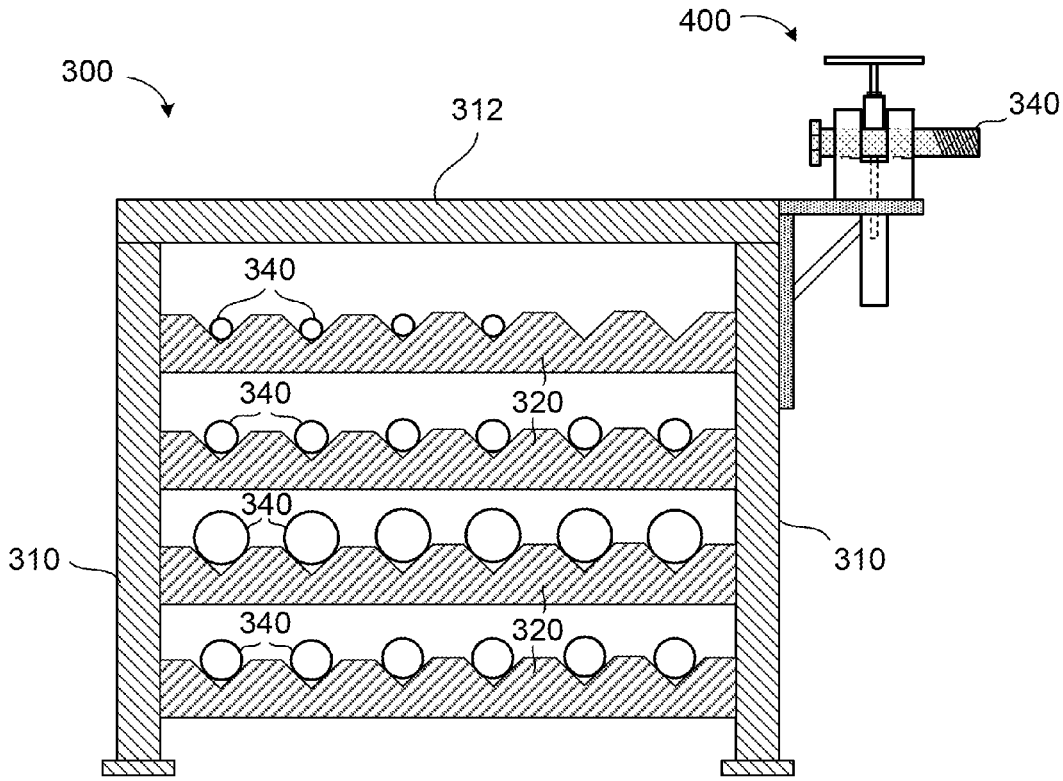
FIG. 7 illustrates a side view of the storage unit of FIG. 3 combined with the fastener clamp of FIGS. 4-6, according to an aspect of the present invention.

FIG. 7 illustrates a side view of the storage unit 300 combined with the fastener clamp 400. The fastener clamp may be mounted to any suitable portion of storage unit 300, or clamped in a vise (not shown) that is attached to the storage unit 300. The bolts 340 may be removed from racks 320 and placed in the fastener clamp 400 for cleaning. The fastener clamp holds the fasteners (e.g., bolts 340) securely so they may be cleaned using a number of suitable devices. For example, the male threads of the bolts 340 may be cleaned by using a female or male wire brush. The threads inside nuts 24 may be cleaned using a male wire brush. In general, for inner diameter threads, such as nut threads, a male wire brush may be preferred, and for outer diameter threads, such as bolt threads, a female wire brush may be the preferred choice.

As can be seen from the above, the process of removing, cleaning and re-installing fasteners in a dynamoelectric machine is facilitated by using the present invention. Bolts, nuts and other fasteners can be neatly organized in the storage unit 300 and orderly removed as they are transferred to the fastener clamp 400 for cleaning. Once cleaning is complete, the fasteners can be returned to storage unit 300. A quick visual inventory may be performed at any time and paired fastener elements (e.g., a nut and bolt) may be arranged so they are not misplaced during the machine outage.

Figure 8:
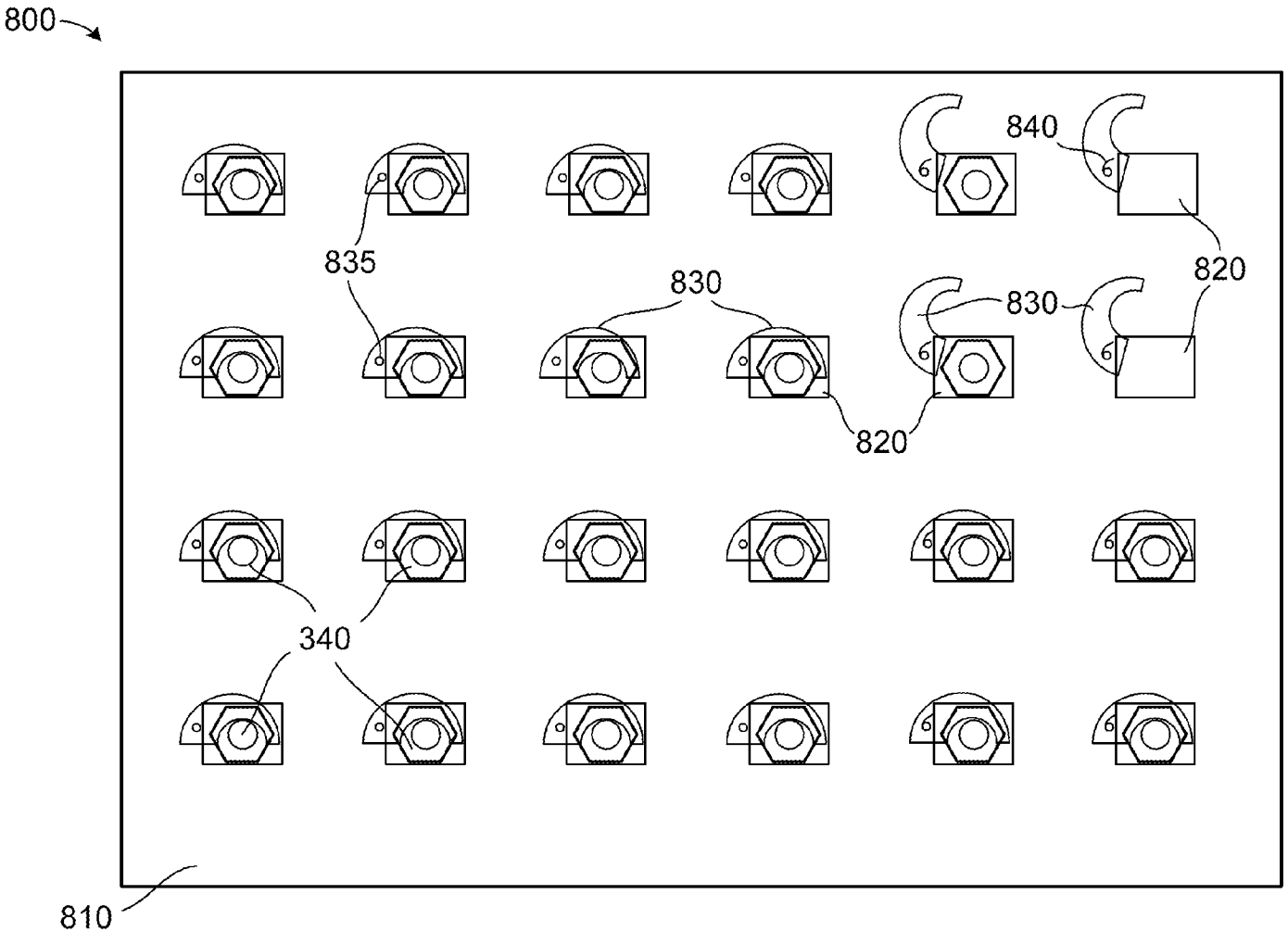
FIG. 8 illustrates a front view of a clamping unit that can be used to secure the fasteners used to join the upper and lower shells in a dynamoelectric machine, according to another aspect of the present invention.

FIG. 8 illustrates a front view of a clamping unit 800 that can be used to secure fasteners 340, according to an aspect of the present invention. The clamping unit 800 includes main body 810 having a plurality of depressions 820 sized to fit the head of a fastener 340 (e.g. a bolt). The depth of depressions 820 may be sized to accommodate all or a portion of the fastener head. The depressions may be milled, cut or created by stacking multiple layers of body 810, where one or more layers will have openings for depressions 820 and other layers may not. Alternatively, and suitable method may be used for creating depressions 820.

The head of fastener 340 may be held in depression 820 with the use of pivoting clamps 830. The clamps 830 can be arranged to pivot about pivot point 835. The pivot points 835 may include a cylindrical member extending from the clamp 830 into main body 810, and may also include spring means (e.g., spring 840) to bias the clamp 830 in the open or closed position. The spring 840 can be any suitable spring, including but not limited to, leaf springs, coiled springs, helical springs, etc. For clarity, springs 840 are only shown on the right two columns of fastener sites, but may be located on some or all of the fastener sites. The open position could be having the clamp 830 in a tilted up or nearly vertical position, which would permit the entry of fastener 340 into depression 820. The closed position could be having the clamp 830 in a nearly horizontal position so that a portion of clamp 830 rests on the shaft of fastener 340.

In operation, a mechanic could orient a clamp 830 in the open position, then insert a fastener head into depression 820. The clamp 830 could be rotated into the closed position so that the fastener's head is retained in depression 820. The depression 820 can be sized to be slightly larger that the diameter of the fastener's head, so that once the fastener's head is inserted into the depression 820, the fastener 340 is prevented from appreciable rotation.

Figure 9:
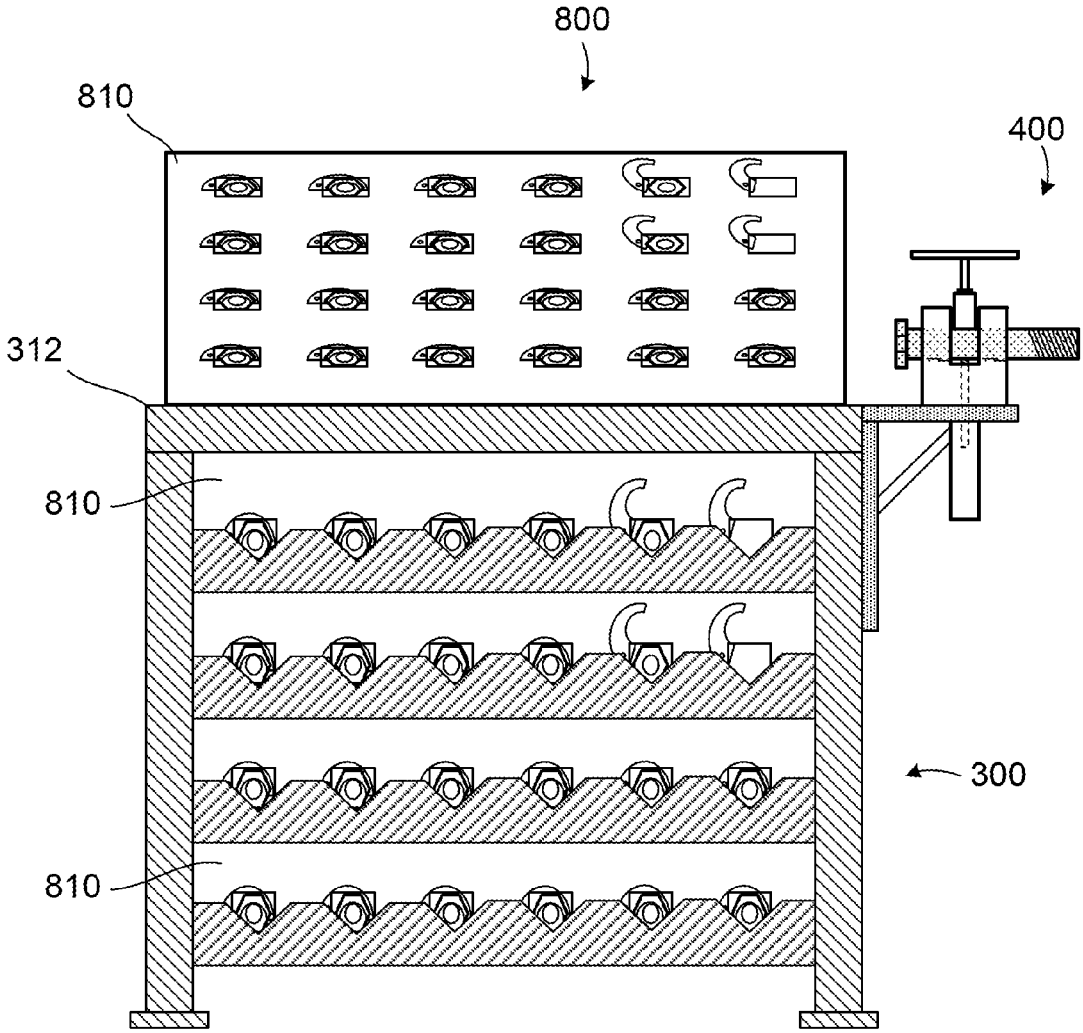
FIG. 9 illustrates a front view of the storage cart of FIG. 3 combined with the fastener clamp of FIGS. 4-6 and the clamping unit of FIG. 8, according to an aspect of the present invention.

Referring to FIG. 9, the storage unit is shown combined with the clamping unit 800 and fastener clamp 400. The clamping unit 800 may be attached to the rear wall of storage unit 300, and/or to top surface 312. If the clamping unit 800 is attached to the top surface 312 of the storage unit 300, it may be arranged to be relatively horizontal, tilted at an angle (with respect to horizontal) or attached in a vertical manner. In FIG. 9, the clamping unit mounted to top surface 312 is shown tilted about forty five degrees with respect to top surface 312. However, and angle orientation may be used as desired for the specific application. Also, the size and configuration (e.g., layout) of the depressions 820 may be customized for each specific application. For example, the depressions may be aligned with notches 330, and/or may have different dimensions to accommodate fasteners of specific sizes.

Figure 10:
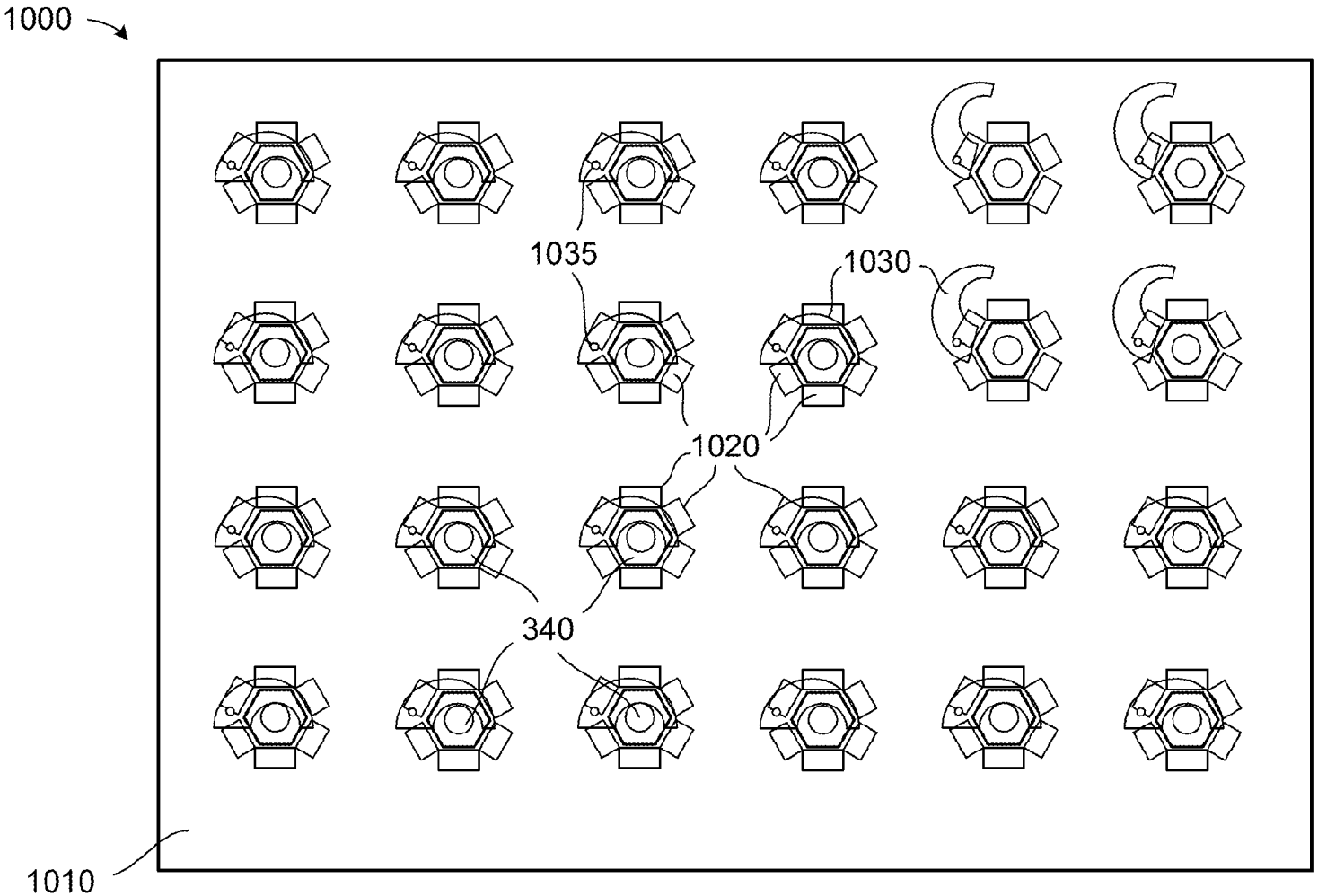
FIG. 10 illustrates a front view of a clamping unit that can be used to secure the fasteners used to join the upper and lower shells in a dynamoelectric machine, according to another aspect of the present invention.

FIG. 10 illustrates a front view of a clamping unit 1000 that can be used to secure fasteners 340, according to an aspect of the present invention. The clamping unit 1000 includes main body 1010 having a plurality of projections 1020 sized to fit the head of a fastener 340 (e.g. a bolt). The height of the projections 1020 may be sized to extend up all or a portion of the fastener's head. The projections 1020 may be adhesively attached, mechanically fastened, milled, cut or created by stacking multiple layers of body 1010, where one or more layers will have projections 1020 and other layers may not. The projections 1020 can be arranged on all or a portion of the sides of the fastener's head, and may comprise an array of spring-biased pins that at least partially conform to the outer shape of the fastener's head. Alternatively, and suitable method may be used for creating projections 1020.

The head of fastener 340 may be held within projections 1020 with the use of pivoting clamps 1030. The clamps 1030 can be arranged to pivot about pivot point 1035. The pivot points 1035 may include a cylindrical member extending from the clamp 1030 into main body 1010, and may also include spring means to bias the clamp 1030 in the open or closed position. The open position permits the entry of fastener 340 into the opening defined by projections 1020, and the closed position is when the clamp 1030 is in a nearly horizontal position so that a portion of clamp 1030 rests on the shaft of fastener 340.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. An apparatus for fasteners used in a dynamoelectric machine comprising:

a frame having a first end wall and a second end wall opposed to the first end wall;

a plurality of shelves connected to and located between the first end wall and the second end wall, at least one of the shelves including a plurality of V-shaped concave regions, the plurality of concave regions configured to retain at least one of the fasteners;

a mounting region for attachment of a fastener clamp, the fastener clamp further comprising a clamp base for securing the fastener clamp to the mounting region, a fastener mounting block having a plurality of V-shaped notches, at least one clamp block for clamping fasteners between the clamp block and at least one of the notches in the fastener mounting block, wherein, fasteners may be cleaned while secured by the fastener clamp;

a threaded rod passing through a first opening in the at least one clamp block, and a second opening in the fastener mounting block, the second opening having female threads and configured to accept the threaded rod, wherein, the threaded rod is secured to the clamp block so that as the threaded rod is rotated in one direction the clamp block is moved toward the fastener mounting block to function as a clamp to securely hold at least one of the fasteners;

wherein the fasteners from the dynamoelectric machine can be placed on the plurality of shelves.

2. The apparatus of claim 1, further comprising a clamping unit, the clamping unit comprising:

a main body having a plurality of fastener retaining sites, each fastener retaining site comprising at least one of a plurality of depressions and a plurality of projections, the fastener retaining sites sized to accommodate at least a portion of a head of one of the fasteners;

wherein, the clamping unit is attached to at least one of a frame and top surface of said apparatus.

3. The apparatus of claim 2, further comprising clamps disposed near each of the fastener retaining sites, the clamps configured to be operable to retain the head of a fastener in a fastener retaining site.

4. The apparatus of claim 3, wherein the clamps are spring-biased in a closed position.

5. An apparatus for fasteners used in a dynamoelectric machine comprising:

a fastener clamp including a clamp base for securing the fastener clamp to a mounting region, a fastener mounting block having a plurality of V-shaped notches, and at least one clamp block for clamping fasteners between the clamp block and at least one of the V-shaped notches in the fastener mounting block;

wherein, fasteners may be secured by the fastener clamp.

6. The apparatus of claim 5, the fastener clamp further comprising:

a threaded rod passing through a first opening in the clamp block, and a second opening in the fastener mounting block, the second opening having female threads and configured to accept the threaded rod;

wherein, the threaded rod is secured to the clamp block so that as the threaded rod is rotated in one direction the clamp block is moved toward the fastener mounting block to function as a clamp to securely hold at least one of the fasteners.

7. The apparatus according to claim 5 further comprising a storage unit, the storage unit comprising:

a frame having a first end wall and a second end wall opposed to the first end wall;

a plurality of shelves connected to and located between the first end wall and the second end wall, at least one of the shelves including a plurality of concave regions, the concave regions configured to retain at least one of the fasteners;

a mounting region for attachment of the fastener clamp;

wherein fasteners from the dynamoelectric machine can be stored on the plurality of shelves.

8. The apparatus of claim 7, further comprising a clamping unit, the clamping unit comprising:

a main body having a plurality of fastener retaining sites comprising at least one of a plurality of depressions and a plurality of projections, each fastener retaining site sized to accommodate at least a portion of a head of one of the fasteners;

wherein, the clamping unit is attached to at least one of a frame and top surface of said apparatus.

9. The apparatus of claim 8, further comprising clamps disposed near each of the fastener retaining sites, the clamps configured to be operable to retain the head of a fastener in a fastener retaining site.

10. The apparatus of claim 9, wherein the clamps are spring-biased in a closed position.

11. An apparatus for organizing and cleaning fasteners used in a dynamoelectric machine comprising:

a clamping unit having a main body having a plurality of fastener retaining sites, the fastener retaining sites comprised of at least one of a plurality of depressions and plurality of projections, the fastener retaining sites sized to accommodate at least a portion of a head of one of the fasteners;

a plurality of clamps, one of the clamps located near each of the fastener retaining fastener retaining site;

a storage unit comprising a frame having a first end wall and a second end wall opposed to the first end wall, a plurality of shelves connected to and located between the first end wall and the second end wall, at least one of the shelves including a plurality of V-shaped concave regions, the V-shaped concave regions configured to retain at least one of the fasteners, a mounting region for attachment of a fastener clamp; and wherein fasteners from the dynamoelectric machine can be stored on the plurality of shelves, and wherein, the clamping unit is attached to at least one of a frame and top surface of the apparatus.

12. The apparatus of claim 11, further comprising a fastener clamp, the fastener clamp comprising:

a clamp base for securing the fastener clamp to the mounting region;

a fastener mounting block having a plurality of notches;

at least one clamp block for clamping the fasteners between the clamp block and at least one of the notches in the fastener mounting block;

wherein, fasteners may be secured by the fastener clamp.

13. The apparatus of claim 12, the fastener clamp further comprising:

a threaded rod passing through a first opening in the clamp block, and a second opening in the fastener mounting block, the second opening having female threads and configured to accept the threaded rod;

wherein, the threaded rod is secured to the clamp block so that as the threaded rod is rotated in one direction the clamp block is moved toward the fastener mounting block to function as a clamp to securely hold at least one of the fasteners.

* * * * *